US008444501B2

(12) United States Patent
Olsson et al.

(10) Patent No.: US 8,444,501 B2
(45) Date of Patent: May 21, 2013

(54) SET OF GOLF CLUBS

(75) Inventors: Breit Olsson, Sollentuna (SE); Tony Björkman, Östhammar (SE)

(73) Assignee: Isaren AB, Sollentuna (SE)

( * ) Notice: Subject to any disclaimer, the term of this patent is extended or adjusted under 35 U.S.C. 154(b) by 336 days.

(21) Appl. No.: 12/743,332

(22) PCT Filed: Dec. 17, 2008

(86) PCT No.: PCT/SE2008/000719

§ 371 (c)(1), (2), (4) Date: May 17, 2010

(87) PCT Pub. No.: WO2009/082323

PCT Pub. Date: Jul. 2, 2009

(65) Prior Publication Data

US 2010/0255925 A1 Oct. 7, 2010
US 2011/0281662 A9 Nov. 17, 2011

Related U.S. Application Data

(60) Provisional application No. 61/015,801, filed on Dec. 21, 2007, provisional application No. 61/021,383, filed on Jan. 16, 2008.

(30) Foreign Application Priority Data

Dec. 21, 2007 (SE) ..... 0702905-1

(51) Int. Cl.
*A63B 53/00* (2006.01)

(52) U.S. Cl.
USPC ..... 473/287; 473/292; 473/289

(58) Field of Classification Search ..... 473/287, 473/409, 289
See application file for complete search history.

(56) References Cited

U.S. PATENT DOCUMENTS

| | | | | |
|---|---|---|---|---|
| 3,698,239 | A | 10/1972 | Everett, III | |
| 3,703,824 | A | 11/1972 | Osborne et al. | |
| 4,128,242 | A | 12/1978 | Elkins, Jr. | |
| 4,157,181 | A * | 6/1979 | Cecka | 473/319 |
| 4,415,156 | A | 11/1983 | Jorgensen | |
| 5,294,118 | A * | 3/1994 | Iwanaga | 473/316 |
| 5,318,296 | A | 6/1994 | Adams et al. | |

(Continued)

FOREIGN PATENT DOCUMENTS

| | | |
|---|---|---|
| JP | 11267249 | 10/1999 |
| JP | 2001286582 | 10/2001 |
| WO | 0062872 | 10/2000 |

*Primary Examiner* — Stephen L. Blau
(74) *Attorney, Agent, or Firm* — Capitol City TechLaw

(57) ABSTRACT

The present invention relates to a set of at least three golf clubs having different club length $L_k$. The golf clubs 14; 20 comprises a shaft 21 with an upper end and a lower end, a grip section 22 on the upper end of the shaft, and a head 23; 30; 40 with a ball-striking surface mounted on the lower end of the shaft. The club length $L_k$ of each golf club decreasing through the set and a value 61, 65, 75; 62, 66, 76; 63,67,77; 64, 68; 78 of at least one torsional moment PCF; HCF; ICF; GCF for each of the at least three golf clubs when swung by a golfer differs from each other. A linear function 71, 72, 73, 74 of club length $L_k$ is based on the values of at least one torsional moment.

20 Claims, 4 Drawing Sheets

U.S. PATENT DOCUMENTS

| | | | | |
|---|---|---|---|---|
| 5,351,953 | A | 10/1994 | Mase | |
| 5,769,733 | A | 6/1998 | Williams et al. | |
| 5,879,241 | A | 3/1999 | Cook et al. | |
| 5,971,865 | A * | 10/1999 | Shenoha et al. | 473/316 |
| 6,835,143 | B2 | 12/2004 | Shiraishi | |
| 6,929,562 | B2 * | 8/2005 | Kumamoto | 473/319 |
| 7,147,572 | B2 * | 12/2006 | Kohno | 473/314 |
| 2002/0107089 | A1 * | 8/2002 | Yamada | 473/319 |
| 2003/0073507 | A1 | 4/2003 | Shiraishi | |
| 2006/0234809 | A1 | 10/2006 | Gilbert et al. | |

* cited by examiner

SET OF GOLF CLUBS

CROSS REFERENCE TO RELATED APPLICATIONS

This application claims the benefit of U.S. Provisional Application Nos. 61/015,801, filed Dec. 21, 2007, and 61/021,383, filed Jan. 16, 2008.

TECHNICAL FIELD

The present invention relates to a set of golf clubs, comprising at least three golf clubs of different length.

BACKGROUND

Golf is a very complex game, in which two rounds of golf on the same golf course will not be identical no matter how many rounds of golf are played, but there are some fundamental conditions that always apply.

The possible length a ball will fly is controlled by the ball speed, the launch angle, and the spin generated on the ball when hit by the golf club (i.e. at impact). The ball is in turn affected by the speed of the club and the kinetic energy transfer that occurs between the golf club and the ball. It means that with the same type of hit on the ball, more speed of the club is needed to transport the ball a longer distance and less speed on the club is needed to transport the ball a shorter distance. If a golfer should be able to hit a ball as far as possible, a golf club that generates maximum speed with maintained accuracy to hit the ball needs to be provided.

Golf is not just about hitting the ball far, but also to know how far a golf club will transport the ball when hit by a golfer in order to choose the right golf club to transport a ball a desired distance. Another factor is to be able to control the direction of the ball. Furthermore, ball flight (to be able to control the roll of the ball after landing) and different types of spins are other parameters that should be considered.

A golfer is allowed to bring 14 golf clubs on to the course (of which at least one is a putter). These golf clubs have different characteristics that are used by the golfer to try and control the parameters described above. Prior art golf clubs are normally designed to have ½ inch (12.7 mm) difference between the iron clubs. The length of the driver is normally approximately 45 inches (1 143 mm).

In order to make the golf clubs feel the same way for a golfer different techniques have been developed during the years.

One technique is to balance the golf clubs in a swingweight apparatus to achieve the same swingweight for each golf club. Another technique is to design the golf clubs using MOI (Moment of Inertia) in which the golf clubs are tuned hanging from a holder and put in a pendulum motion. MOI will give a good indication of the torsional moment for the golf clubs as such, and aim of the technique is to achieve the same MOI for all golf clubs in a set, as disclosed in U.S. Pat. No. 5,769,733.

A technique to dynamically adapt a set of golf clubs is described in U.S. Pat. No. 5,351,953, in which a moment of inertia ($I_{xy}$) may differ between clubs having different loft without any relationship to the length of each golf club.

In U.S. Pat. No. 6,835,143 a method is disclosed for evaluating a set of golf clubs having different length and loft. Each golf club is adapted to control the flight performance and flight distance of a golf ball.

Club fitting may be performed to investigate and determine the length, lie (angle between the club head and the shaft), swingweight or MOI that is most suitable for a golfer. Club fitting is performed in advanced system in which sensors register behavior of the ball and the golf club when hitting the ball (i.e. at impact). The goal of all types of club fitting is to try and provide the golfer with equipment adapted to the golfer which will give the golfer better playing conditions.

The fundamental condition for all club fittings is that the golfer has established a muscle memory (practiced motion) such that a golf stroke with a certain golf club is good. It is also important that the golf club is manufactured in such a way that the golfer, in a physical perspective, manage to repeat the motion of the golf club in a similar way, over and over again.

A problem with prior art techniques is that although some design parameters are considered, others parameters that affect the ability to hit the ball repeatedly are not considered. One parameter is how the swing changes when the length of the golf club is changed. Different club length will result in different stances when addressing the ball with clubs having different lengths. The angles between the upper part of the body of the golfer, the wrists and club will vary dependent on the club length, which is a clear indication that the identical swing motion cannot be achieved for golf clubs having different length.

SUMMARY OF THE INVENTION

An object with the present invention is to provide a set of golf clubs that are adapted to compensate for changes in swing motion of a golfer for golf clubs having different length.

This object is achieved by a set of golf clubs comprising at least three golf clubs with different length. Each golf club generate at least one torsional moment when swung by a golfer being different from each other, and the at least one torsional moment is an essential linear function of club length.

An advantage with the present invention is that the golfer will be able to handle each golf club in the golf set using the golfer's natural swing motion when hitting a golf ball.

Another advantage with the present invention is that the golfer does not need to adjust the swing motion to the length of each golf club in a set, as is the case with prior art equipment.

Further objects and advantages may be found by a skilled person in the art from the detailed description.

BRIEF DESCRIPTION OF DRAWINGS

The invention will be described in connection with the following drawings that are provided as non-limited examples, in which.

DETAILED DESCRIPTION

The fundamental principal of the invention relates to how the human body affects the ability to play golf. In a closer analysis of the forces applied to the human body when swinging a golf club, the muscles may be divided into large muscle groups and small muscle groups. The large muscle groups perform the heavy work and the small muscle groups handle the fine details. They work together during a golf stroke to create a homogenous motion. In order for a golf club to be good, it needs to be in tune with both large and small muscle groups.

The tuning of the muscle groups in the prior art methods, as described above, in order to design or adapt golf clubs will not be true for all the golf clubs in a set. Every now and then, a golf club is found, e.g. an iron 7, that is very well adapted to a specific golfer, but a gradually deteriorating adaptation is present for the longer and shorter clubs in the set.

Figure 1:
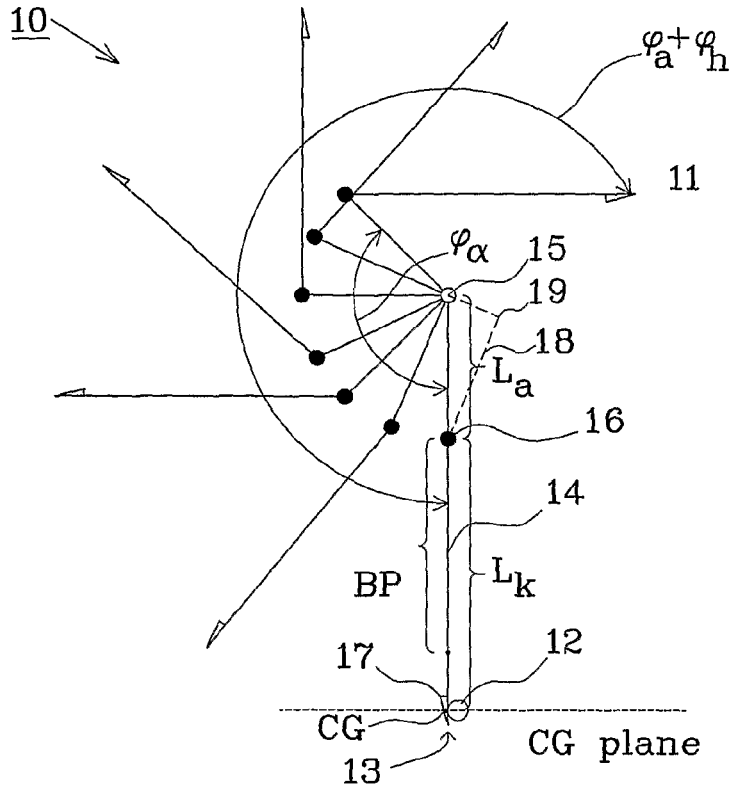
FIG. 1 shows an example of a swing motion.

The theoretical background to the concept of the invention is to see what happens, and what should happen, when a golfer hits a ball with a golf club. Everything in golf that occurs up to the point when the swing motion starts are preparations in order for the golfer to be able to perform a golf stroke as intended. These preparations include analysis of the ball's position, choice of the type of stroke that is applicable, choice of golf club, and line of play. The golfer then moves into position to hit the ball, i.e. takes the stance. FIG. 1 illustrates a swing motion 10 of a golfer when hitting a ball. The swing motion starts at a top position 11 and moves towards the ball 12 which is placed in a bottom position 13. Energy transfer between a golf club 14, having a club length $L_k$, and the ball 12 occurs during impact at the bottom position 13.

A distance $L_a$ between the upper part 16 of the golf club 14 and the rotational centre 15 of swing motion, which distance is related to the arm length of the golfer, is considered to be constant during the swing motion. The arm length of the golfer (18) and the length from the shoulder socket (19) to the rotational centre (15) are sides in a triangle, and $L_a$ is the hypotenuse of the triangle. The swing motion also depends on a number of variables, such as the position of the balance point BP in relation to the upper part 16 of the golf club 14, which are going to be described in more detail below.

Figure 3A:
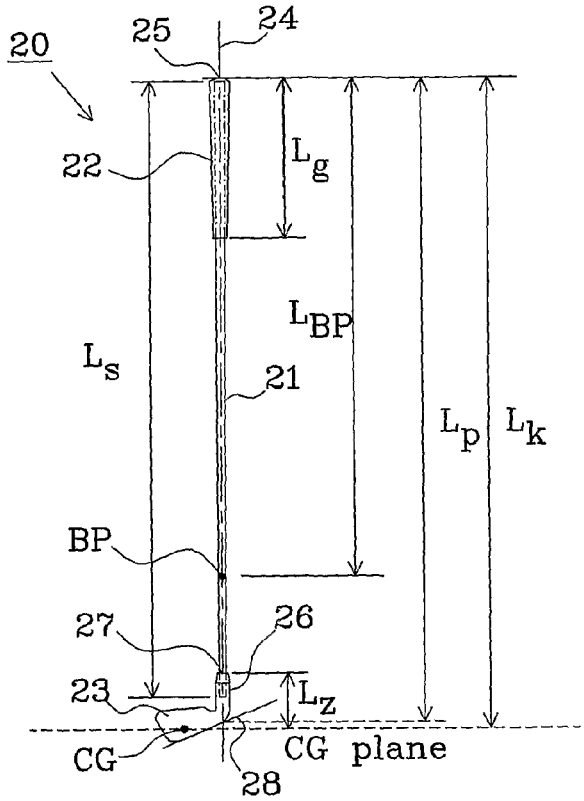
FIG. 3*a* shows a side view of a golf club.

The golf club comprises a grip section (not shown), a shaft (not shown), and a golf head 17 having a centre of gravity CG. A CG plane, which is perpendicular to a direction along the centre of the shaft, is illustrated with a dashed line through CG of the golf head 17 (see also description in connection with FIG. 3*a*). The club length $L_k$ is defined as the distance from the upper part 16 to the CG plane. It is also possible to define the club length $L_k$ and the distance $L_a$ in another way, e.g. a predetermined distance down on the grip section, e.g. 6 inches (152.4 mm) down from the upper part 16 of the golf club 14. However, in this description the definition described in connection with FIGS. 1 and 3*a* is used.

It should be noted that the swing motion does not end at impact, i.e. the bottom position (13), but continuous forward in an anti-clockwise direction as the golfer swings through. This is, however, not shown in FIG. 1 for sake of clarity.

The muscles of the golfer have been loaded with energy at the top position 11 to perform a golf stroke, and the muscles have been discharged at the bottom position 13 to generate energy to the golf stroke. The muscles may, as mentioned above, be divided into large muscles groups and small muscle groups. The large muscles groups are considered to be related to the body of the golfer, and the small muscle groups are considered to be related to the wrists (and to some extent the arms) of the golfer. The golf swing is a motion with an even acceleration from the top position 11 to the bottom position 13, where the golf club hits the ball 12.

The torsional moments that the muscles need to generate, in order to transfer energy to the ball at the bottom position, may be analyzed and be divided into a first torsional moment, herein referred to as PCF (Plane Control Factor), and a second torsional moment, herein referred to as ICF (Impact Control Factor). These quantities may be expressed in mathematical equations:

$$PCF=(L_a+L_{BP})\cdot a_{BP}\cdot m_1 \tag{1}$$

$$ICF=L_{BP}\cdot(a_{BP}-a_h)\cdot m_k \tag{2}$$

wherein $L_a$ is a constant (related to the arm length of the golfer), $L_{BP}$ is the balance point length from the upper part 16 of the golf club 14 to the balance point BP of the golf club 14, $a_{BP}$ is the acceleration in the balance point BP, $a_h$ is the acceleration in the wrists of the golfer (which are considered to be positioned at the upper part 16 of the golf club 14), and $m_k$ is the club weight.

The acceleration in the balance point may be expressed as:

$$a_{BP}=\frac{(v_{BP})^2}{2\cdot S_{BP}}, \tag{3}$$

wherein $v_{BP}$ is the speed in the balance point, and $S_{BP}$ is the distance the balance point travels. These may be expressed as:

$$S_{BP}=\frac{v_{BP}\cdot t}{2}\Rightarrow v_{BP}=\frac{2\cdot S_{BP}}{t} \tag{4}$$

$$\begin{aligned} S_{BP}&=\frac{\varphi_a}{360}\cdot 2\pi\cdot(L_a+L_{BP})+\frac{\varphi_h}{360}\cdot 2\pi\cdot L_{BP}\Rightarrow \text{if } \varphi_a=\varphi_h\Rightarrow \\ S_{BP}&=\frac{\varphi_a}{360}\cdot 2\pi\cdot L_a+2\cdot\frac{\varphi_h}{360}\cdot 2\pi\cdot L_{BP}=K_1+K_2\cdot L_{BP} \end{aligned} \tag{5}$$

The acceleration in the wrists may be expressed as:

$$a_h=\frac{(v_h)^2}{2\cdot S_h}, \tag{6}$$

wherein $v_h$ is the speed in the wrists, and $S_h$ is the distance the wrists travel. $S_h$ may be expressed as:

$$S_h=\frac{\varphi_a}{360}\cdot 2\pi\cdot L_a=K_1 \tag{7}$$

Equation (4) is inserted into equation (3):

$$a_{BP}=\frac{(v_{BP})^2}{2\cdot S_{BP}}=\frac{\left(\frac{2\cdot S_{BP}}{t}\right)^2}{2\cdot S_{BP}}=\frac{2\cdot S_{BP}}{t^2}=K_3\cdot S_{BP}, \tag{8}$$

The acceleration in the wrists may be expressed in the same way:

$$a_h = \frac{(v_{BP})^2}{2 \cdot S_h} = \frac{2 \cdot S_h}{t^2} = K_3 \cdot S_h, \tag{9}$$

Equation (5) is inserted into equation (8), and equation (7) is inserted into equation (9) which yields:

$$a_{BP} = K_3 \cdot (K_1 + K_2 \cdot L_{BP}) = K_1 \cdot K_3 + K_2 \cdot K_3 \cdot L_{BP}, \tag{10a}$$

$$a_h = K_1 \cdot K_3, \tag{10b}$$

$$\Rightarrow a_{BP} - a_h = K_2 \cdot K_3 \cdot L_{BP} \tag{11}$$

Equation (2) may then be expressed as:

$$\begin{aligned} ICF &= L_{BP} \cdot (a_{BP} - a_h) \cdot m_k \\ &= K_2 \cdot K_3 \cdot (L_{BP})^2 \cdot m_k \Rightarrow \end{aligned} \tag{12}$$

$$m_k = \frac{ICF}{K_2 \cdot K_3 \cdot (L_{BP})^2} \Rightarrow$$

$$L_{BP} = \pm \sqrt{\frac{ICF}{K_2 \cdot K_3 \cdot m_k}}$$

The weight of the club $m_k$ is extracted from equation (13) and is inserted into equation (1) together with equation (10a):

$$\begin{aligned} PCF &= (L_a + L_{BP}) \cdot a_{BP} \cdot m_k = \\ &(L_a + L_{BP})(K_1 \cdot K_3 + K_2 \cdot K_3 \cdot L_{BP}) \cdot \frac{ICF}{K_2 \cdot K_3 \cdot (L_{BP})^2} \Rightarrow \end{aligned} \tag{13}$$

$$PCF = \left( \frac{K_1 \cdot K_3 \cdot ICF}{K_2 \cdot K_3 \cdot (L_{BP})^2} + \frac{K_2 \cdot K_3 \cdot ICF \cdot L_{BP}}{K_2 \cdot K_3 \cdot (L_{BP})^2} \right) \cdot (L_a + L_{BP}) \Rightarrow$$

$$PCF = \left( \frac{K_1 \cdot ICF}{K_2 \cdot (L_{BP})^2} + \frac{ICF}{L_{BP}} \right) \cdot (L_a + L_{BP}) \Rightarrow$$

$$PCF = \frac{K_1 \cdot ICF \cdot L_a}{K_2 \cdot (L_{BP})^2} + \frac{K_1 \cdot ICF \cdot L_{BP}}{K_2 \cdot (L_{BP})^2} + \frac{ICF \cdot L_a}{L_{BP}} + \frac{ICF \cdot L_{BP}}{L_{BP}} \Rightarrow$$

$$PCF = \frac{1}{(L_{BP})^2} \cdot \left( \frac{K_1 \cdot ICF \cdot L_a}{K_2} \right) + \frac{1}{L_{BP}} \cdot \left( \frac{K_1 \cdot ICF}{K_2} + \frac{K_2 \cdot ICF \cdot L_a}{K_2} \right) + ICF \Rightarrow$$

$$(L_{BP})^2 \cdot PCF = \frac{K_1 \cdot ICF \cdot L_a}{K_2} + L_{BP} \cdot \frac{K_1 ICF + K_2 \cdot ICF \cdot L_a}{K_2} + (L_{BP})^2 \cdot ICF \Rightarrow$$

$$(L_{BP})^2 - \frac{K_1 \cdot ICF + K_2 \cdot ICF \cdot L_a}{K_2 \cdot (PCF - ICF)} \cdot L_{BP} - \frac{K_1 \cdot ICF \cdot L_a}{K_2 \cdot (PCF - ICF)} = 0 \Rightarrow$$

$$L_{BP} = \frac{C_1 \cdot ICF}{PCF - ICF} \pm \sqrt{\left( \frac{C_1 \cdot ICF}{PCF - ICF} \right)^2 + \frac{C_2 \cdot ICF}{PCF - ICF}}$$

wherein $$C_1 = \frac{K_1 + K_2 \cdot L_a}{2 \cdot K_2} = \frac{3}{4} L_a, \text{ and}$$

-continued $$C_2 = \frac{K_1 \cdot L_a}{K_2} = \frac{(L_a)^2}{2}$$

provided that $\phi_a = \phi_h$ as mentioned above in equation (5).

The negative term in equation (13) may be disregarded, since it provides a non-relevant solution, and the balance point length $L_{BP}$ may be calculated for a golf club "n" in a set of golf clubs if PCF and ICF are given for the golf club, and $L_a$ is determined for the golfer, as expressed in equation (14) below (provided $\phi_a = \phi_h$).

$$L_{BP,n} = L_a \cdot \left( \frac{0.75 \cdot ICF_n}{PCF_n - ICF_n} + \sqrt{\left( \frac{0.75 \cdot ICF_n}{PCF_n - ICF_n} \right)^2 + \frac{0.5 \cdot ICF_n}{PCF_n - ICF_n}} \right) \tag{14}$$

The relationship between ICF and PCF for a golf club "n" may be obtained by extracting $a_{BP}$ from equation (2) and insert it into equation (1):

$$PCF_n = \left( \frac{ICF_n}{L_{BP,n} \cdot m_{k,n}} + a_h \right) \cdot (L_{BP,n} + L_a) \cdot m_{k,n} \tag{15}$$

Alternatively, the relationship between ICF and PCF for a golf club "n" may be obtained by extracting $a_{BP}$ from equation (1) and insert it into equation (2):

$$ICF_n = \left( \frac{PCF_n}{(L_{BP,n} + L_a) \cdot m_{k,n}} - a_h \right) \cdot L_{BP,n} \cdot m_{k,n} \tag{16}$$

In addition to the relationships established between ICF and PCF, these quantities may also be expressed as functions of balance point length $L_{BP}$ and club weight $m_k$. ICF may be expressed by inserting the acceleration of the balance point reduced by the acceleration of the wrists from equation (11) into equation (2):

$$ICF = L_{BP} \cdot K_2 \cdot K_3 \cdot L_{BP} \cdot m_k = K_2 \cdot K_3 \cdot m_k \cdot (L_{BP})^2 \propto m_k \cdot (L_{BP})^2 \tag{17}$$

In an MOI matched set of golf clubs, ICF is kept constant between the golf clubs, but this is not the optimal selection due to the change in swing motion by the golfer when the length of the golf club is altered.

Thus, MOI is based on the following relationship between a first golf club and a second golf club within a golf set:

$$m_{k,1}(L_{BP,1})^2 = m_{k,2}(L_{BP,2})^2 \tag{18}$$

Figure 2:
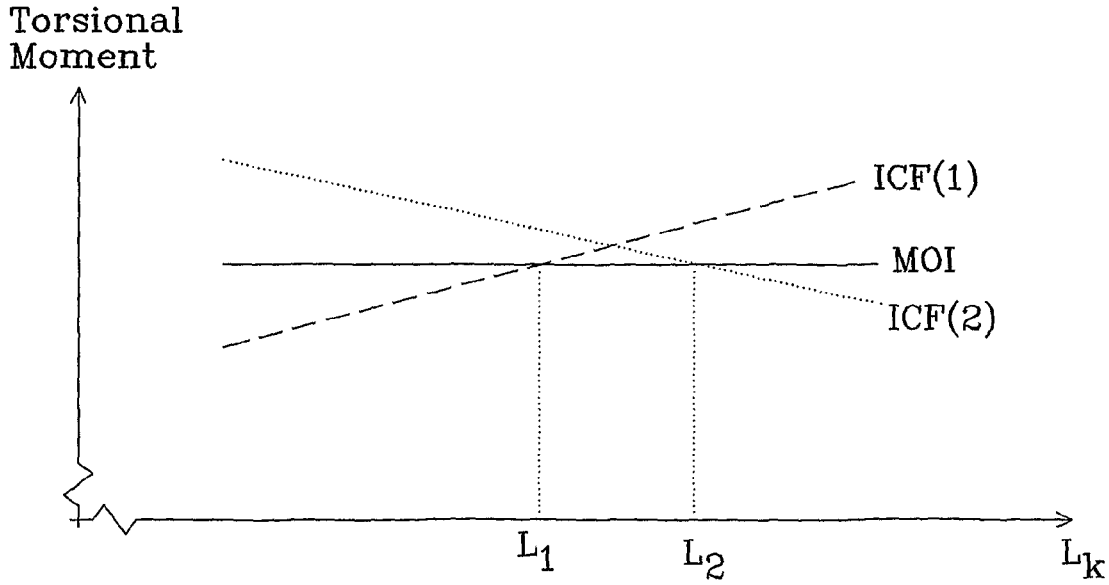
FIG. 2 shows a graph that illustrates the difference between a prior art matching (MOI) and the invention.

This is illustrated in FIG. 2. The continuous line illustrates an MOI matched set of golf clubs having different lengths $L_k$. The torsional moment ICF is constant for every length.

Contrary to MOI, the inventive concept is based on the following relationship between the first golf club and the second golf club within a golf set:

$$m_{k,1}(L_{BP,1})^2 = \alpha \cdot m_{k,2}(L_{BP,2})^2;\ \alpha \neq 1 \tag{19}$$

wherein $\alpha$ represents a linear constant, $m_{k,1}$ is the weight and $L_{BP,1}$ is the balance point length of the first golf club; and $m_{k,2}$ is the weight and $L_{BP,2}$ is the balance point length of the second golf club. The torsional moment ICF according to the invention will differ from the continuous line of MOI dependent on the value of the linear constant $\alpha$, ICF(1) illustrated by a dashed line has $\alpha<1$ as a function of club length, and ICF(2) illustrated by a dotted line has $\alpha>1$ as a function of club length.

The ICF(1) curve cross the MOI curve at a first club length $L_1$, and the ICF(2) curve cross the MOI curve at a second club length $L_2$, which indicate that an MOI matched club with a club length equal to $L_1$ or $L_2$ will have the same ICF as a golf club according to the present invention. It should also be noted that the MOI curve does only cross each ICF curve at one club length, i.e. ICF(1) at $L_1$, and ICF(2) at $L_2$.

PCF may be expressed by inserting the acceleration of the balance point from equation (10a) into equation (1):

$$PCF=(L_a+L_{BP})\cdot(K_1\cdot K_3+K_2\cdot K_3\cdot L_B)\cdot m_k \Rightarrow$$

$$PCF=K_3\cdot(L_a+L_{BP})\cdot(K_1+K_2\cdot L_{BP})\cdot m_k \tag{20}$$

A relationship between $K_1$ and $K_2$ may be obtained from equation (5) under the assumption $\phi_a=\phi_h$, in which:

$$K_1=\frac{1}{2}\cdot K_2\cdot L_a \Rightarrow \tag{21}$$

$$PCF=\frac{K_3\cdot K_2}{2}(L_a+L_{BP})\cdot(L_a+2\cdot L_{BP})\cdot m_k \propto (L_a+L_{BP})\cdot(L_a+2\cdot L_{BP})\cdot m_k$$

The torsional moment PCF is according to the invention a linear function of balance point length $L_{BP}$, and also a function of club length $L_k$ since the location of the balance point is dependent on the club length, whereby the relationship between two golf clubs in a set may be expressed as:

$$m_{k,1}(L_{BP,1}+L_a)\cdot(2L_{BP,1}+L_a)=\delta\cdot m_{k,2}(L_{BP,2}+L_a)\cdot(2L_{BP,2}+L_a);\ \delta\neq 1 \tag{22}$$

wherein $\delta$ represents a linear constant, $m_{k,1}$ is the weight and $L_{BP,1}$ is the balance point length of the first golf club; $m_{k,2}$ is the weight and $L_{BP,2}$ is the balance point length of the second golf club, and $L_a$ is the constant related the golfer's arm length.

Figure 4:
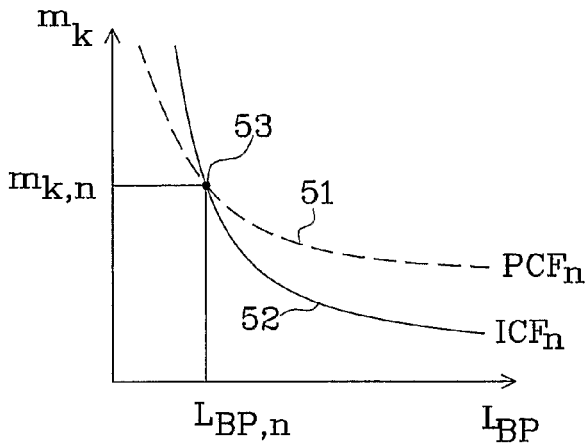
FIG. 4 shows a graph illustrating the behaviour of the first and the second torsional moment as a function of the balance point length according to the invention.

FIG. 4 shows a first graph in which the behaviour of the first torsional moment PCF and the second torsional moment ICF is presented as a function of the balance point length and club weight according to the invention. A first curve 51 (dashed) illustrates equation (21) and a second curve 52 (continuous) illustrates equation (17), when $L_a$, $K_2$ and $K_3$ are constants, and $m_k$ and $L_{BP}$ axe varied. The curves intersect at a point 4353 which gives only one balance point length $L_{BP,n}$ and a corresponding club weight $m_{k,n}$ for a golf club "n" when both equations are fulfilled. This relationship corresponds to equations (15) and (16).

Furthermore, it is desired to be able to control the angle of the golf club head 17 related to the swing plane when hitting the ball 12, and to hit a straight shot. In order to achieve this, the angle needs to be perpendicular to the swing plane at impact, i.e. the golf head needs to be square. The shaft and grip section are cylindrical does not influence the torsional moments applied to the wrists at impact, but the club head will affect the ability to control the golf club.

The torsional moments the muscles need to generate, in order to be able to control the angle at the bottom position, may be analyzed and be divided into a third torsional moment, herein referred to as HCF (Head Control Factor), and a fourth torsional moment, herein referred to as GCF (Gear Control Factor). These quantities may be expressed in mathematical equations:

$$HCF=L_k\cdot(a_{CG}-a_h)\cdot m_{kh} \tag{23}$$

$$GCF=L_{CG}\cdot(a_{CG}-a_h)\cdot m_{kh} \tag{24}$$

wherein $L_k$ is the length of the golf club; $L_{CG}$ is a length of a vector from a point in the CG plane in the prolongation of the centre of the shaft the upper part 16 of the golf club 14 to a point on a line drawn through a sweet spot on the ball-striking surface and the centre of gravity CG, preferably to the CG, of the golf head 17; $a_{CG}$ is the acceleration in CG; $a_h$ is the acceleration in the wrists of the golfer (which are considered to be positioned at the upper part 16 of the golf club 14); and $m_{kh}$ is the club head weight.

FIGS. 3*a*-3*d* illustrate different important definitions for calculating HCF and GCF, as well as a more detailed definition of balance point length needed in calculating PCF and ICF, as described above.

FIG. 3*a* shows a side view of a golf club 20 comprising a shaft 21 with a shaft length $L_s$, a grip section 22 with a grip length $L_g$, and a club head 23 with a centre of gravity CG. The golf club has a balance point BP, and a balance point length $L_{BP}$ is defined as a distance from a distal end 25 of the grip section 22 to the balance point in a first direction defined along a centre line 24 of the shaft 21. The centre of gravity CG is defined to be arranged in a plane (CG plane) perpendicular to the first direction, and a club length $L_k$ is defined as a distance from the distal end 25 of the grip section 22 to the CG plane along the first direction. A play length $L_p$, which is the club length experienced by the golfer when swinging the golf club, is defined as the distance from the distal end of the grip section 22 to the ground (illustrated with line 28) when the centre of the sole of the club head is touching the ground 28. Normally $L_p$ is approximately equal to $L_k$ unless CG is positioned very low (as in FIG. 3*a*) or very high in the club head 23.

The club head 23, having a club head weight $m_{kh}$, is provided with a hosel 26 and a hosel bore in which the shaft 21 is attached. The position of the CG is in this description defined in relation to a centred point 27 at the top of the hosel 26, and may be expressed in three components $L_x$, $L_y$, and $L_z$. The third component $L_z$ is defined along the first direction from the centred point 27 to the CG plane, see FIG. 3*a*. The first $L_x$ and second $L_y$ components are arranged in the CG plane and defined as illustrated in FIGS. 3*b* and 3*c*.

Figure 3D:
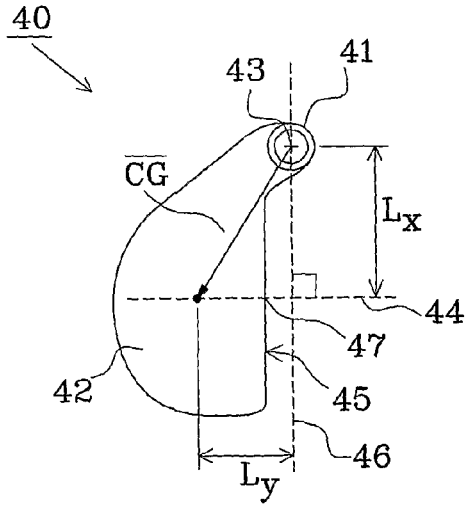
FIG. 3*d* shows a top view of a second type of club head.
Figure 3B:
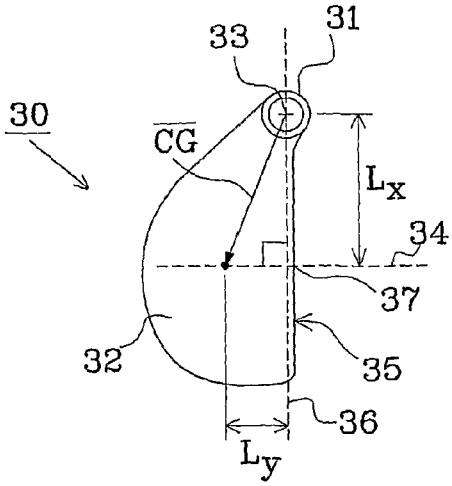
FIG. 3*b* shows a top view of a first type of club head.
Figure 3C:
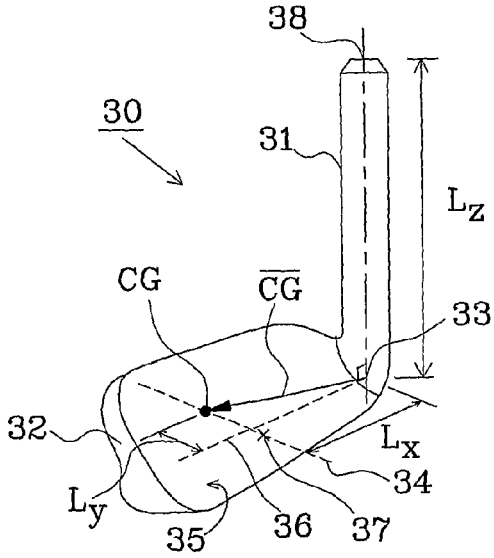
FIG. 3*c* shows a perspective view of the first type of club head in FIG. 3*b*.

FIG. 3*b* shows a top view and FIG. 3*c* shows a perspective view of a conventional club head 30 having a hosel 31 with a hosel bore and a club blade 32. A zero point 33 is indicated in the hosel 31 and is defined as the point in the CG plane where the prolongation of the centre line 24 of the shaft 21 intersects the CG plane. The $L_z$ component is defined as the distance from a centred point 38 at the top of the hosel 31, and a vector $\overline{CG}$ is defined between the zero point 33 and CG. The vector may be divided into the first and second $L_y$ components as mentioned above. $L_x$ is defined as the distance between zero point 33 and a line 34 passing through CG and is perpendicular to the face of the ball striking surface 35 of the club head 30. $L_y$ is defined as the distance between CG and a line 36 passing through the zero point 33 and is parallel to the face of the ball striking surface 35 of the club head 30. The point 37 where line 34 intersects with the ball striking surface 35 is normally called "sweet spot", as the centre of gravity CG is arranged directly behind that point during impact (at bottom position in FIG. 1) provided the club head is square. For a conventional club head, the distance to the sweet spot 37 from CG is larger than $L_y$, as indicated in FIG. 3*b*.

FIG. 3*d* shows a perspective view of a club head 40 with an offset hosel design comprising a hosel 41 and a club blade 42. A zero point 43 is indicated in the hosel 41, defined in the same way as in FIG. 3*b*. A vector $\overline{CG}$ is defined between the zero point 43 and CG, and the vector may be divided into the first $L_x$ and second $L_y$ components as mentioned above. $L_x$ is defined as the distance between zero point 43 and a line 44 passing through CG and is perpendicular to the face of the ball striking surface 45 of the club head 40. $L_y$ is defined as the distance between CG and a line 46 passing through the zero point 43 and is parallel to the face of the ball striking surface 45 of the club head 40. The distance to a sweet spot 47 is in this embodiment shorter than $L_y$.

It should be noted, in order to calculate the fourth torsional moment GCF, it is preferred that the CG length $L_{CG}$ is the length of the vector $\overline{CG}$ due to the fact that the position of CG will affect the feeling of the golf club during the swing motion. Alternatively, the first component $L_x$ may be used as CG length $L_{CG}$ due to the fact that CG will be positioned directly behind the sweet spot 37, 47 at impact, but any point on the line 34, 44, that passes through CG and sweet spot 37, 47 may be used as $L_{CG}$ to calculate GCF.

From equations (23) and (24) it is apparent that the relationship between HCF and GCF may be expressed as:

$$\frac{HCF}{L_k} = \frac{GCF}{L_{CG}} \Rightarrow GCF = \frac{L_{CG}}{L_k} HCF \tag{25}$$

and the CG length $L_{CG}$ may be expressed as:

$$L_{CG} = \frac{GCF}{HCF} \cdot L_k \tag{26}$$

HCF according to equation (23) is a function of club length $L_k$, the club head weight $m_{kh}$, and the acceleration difference in CG and the wrists ($a_{CG}-a_h$). The acceleration in the wrists is expressed in equation (10b)

$$a_h = K_1 \cdot K_3 \tag{10b}$$

The acceleration in CG may be calculated in the same way as the acceleration in the balance point BP, if the club weight is replaced by the weight of the club head and the balance point length is replaced with club length, which results in:

$$a_{CG} = K_3 \cdot (K_1 + K_2 \cdot L_k) = K_1 \cdot K_3 + K_2 \cdot K_3 \cdot L_k \tag{27a}$$

The acceleration difference ($a_{CG}-a_h$) may be expressed as:

$$a_{CG} - a_h = K_2 \cdot K_3 \cdot L_k \tag{27b}$$

$$\Rightarrow HCF = L_k \cdot (a_{CG} - a_h) \cdot m_{kh} = K_2 \cdot K_3 \cdot (L_k)^2 \cdot m_{kh} \Rightarrow$$

$$m_{kh} = \frac{HCF}{K_2 \cdot K_3 \cdot (L_k)^2} \Rightarrow \tag{28}$$

$$L_k = \pm \sqrt{\frac{HCF}{K_2 \cdot K_3 \cdot m_{kh}}}$$

Figure 5:
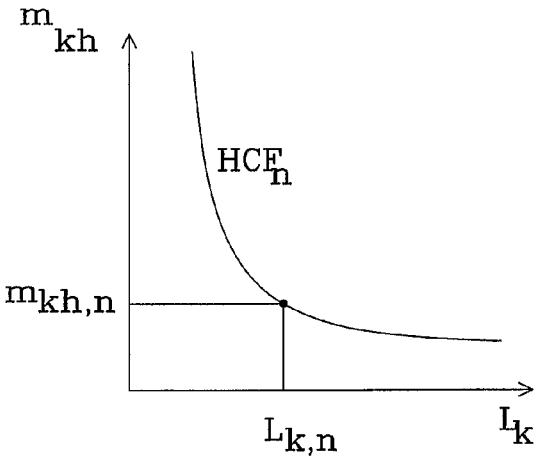
FIG. 5 shows a graph illustrating the behaviour of the third torsional moment as a function of club head weight and club length according to the invention.

FIG. 5 shows graph illustrating the behaviour of the third torsional moment $HCF_n$ as a function of club length $L_k$ and club head weight $m_{kh}$ for golf club "n" according to the invention since $K_2$ and $K_3$ are constants. A given value for $HCF_n$ for a golf club "n" results in the freedom to choose a club length $L_{k,n}$ for that golf club that will result in a desired club head weight $m_{kh,n}$, or a club head weight $m_{kh,n}$ may be chosen that will result in a desired club length $L_{k,n}$, to obtain an optimal Head Control Factor.

The inventive concept is based on the understanding that golfers alter the swing dependent on the golf club length $L_k$ and thus the third torsional moment HCF may also change since it is proportional to the square of the club length as expressed in equation (28). Therefore it is possible to form a relationship between a first golf club and a second golf club having different lengths in the set of golf clubs:

$$m_{kh,1}(L_{k,1})^2 = \beta \cdot m_{kh,2}(L_{k,2})^2 \tag{29}$$

wherein $m_{kh,1}$ is the head weight and $L_{k,1}$ is the club length of a first golf club; and $m_{kh,2}$ is the head weight and $L_{k,2}$ is the club length of a second golf club. β normally differs from one ($\beta \neq 1$) but it is conceivable to design a set of golf clubs in which the golf clubs have the same HCF although they have different length, i.e. $L_{k,1} \neq L_{k,2}$.

Similarly, the fourth torsional moment GCF may, by introducing the acceleration difference between the wrists and the CG as stated in equation (27b) in equation (24), be expressed as:

$$GCF = L_{CG} \cdot (a_{CG} - a_h) \cdot m_{kh} = K_2 \cdot K_3 \cdot L_k \cdot L_{CG} \cdot m_{kh} \Rightarrow \tag{30}$$

$$m_{kh} = \frac{GCF}{K_2 \cdot K_3 \cdot L_k \cdot L_{CG}} \Rightarrow$$

$$L_{CG} = \frac{GCF}{K_2 \cdot K_3 \cdot L_k \cdot m_{kh}}$$

Figure 6:
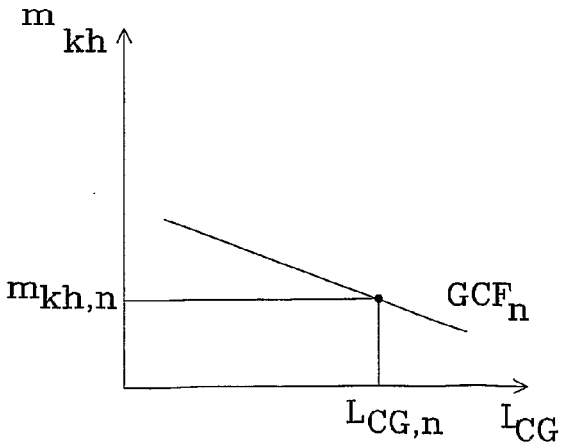
FIG. 6 shows a graph illustrating the behaviour of the fourth torsional moment as a function of club head weight and CG length according to the invention.

FIG. 6 shows a graph illustrating the behaviour of the fourth torsional moment $GCF_n$ for a golf club having a predetermined club length $L_{k,n}$ as a function of CG length $L_{CG}$ and club head weight $m_{kh}$ for golf club "n" according to the invention since $K_2$ and $K_3$ are constants. A given value for $GCF_n$ for a golf club "n" having a predetermined club length $L_{k,n}$ results in the freedom to choose CG length $L_{CG,n}$, for that golf club that will result in a desired club head weight $m_{kh,n}$, or a club head weight $m_{kh,n}$ may be chosen that will result in a desired CG length $L_{CG,n}$, to obtain an optimal Gear Control Factor.

The inventive concept is, as mentioned above, based on the understanding that golfers alter the swing dependent on the golf club length $L_k$ and thus the fourth torsional moment GCF may also change since it is proportional to the club length as expressed in equation (29). Therefore it is possible to form a relationship between a first golf club and a second golf club having different lengths in the set of golf clubs:

$$m_{kh,1} \cdot L_{k,1} \cdot L_{CG,1} = \gamma \cdot m_{kh,2} \cdot L_{k,2} \cdot L_{CG,2} \tag{31}$$

wherein $m_{kh,1}$ is the head weight, $L_{k,1}$ is the club length and $L_{CG,1}$ is the CG length of the first golf club; and $m_{kh,2}$ is the head weight, $L_{k,2}$ is the club length and $L_{CG,2}$ is the CG length of the second golf club. γ normally differs from one ($\gamma \neq 1$) but it is conceivable to design a set of golf clubs in which the golf clubs have the same GCF although they have different length, i.e. $L_{k,1} \neq L_{k,2}$.

From equation (29) and equation (30) it is obvious that HCF and GCF are not based on the club weight $m_k$ or balance point length $L_{BP}$ for different golf clubs within the same set of golf clubs. Similarly, from equation (22) and equation (19) it is obvious that PCF and ICF are not based on the club head weight $m_{kh}$ or CG length $L_{CG}$ for different golf clubs within the same set of golf clubs. It should also be noted that PCF and ICF are not directly based on club length $L_k$ either, but one of the fundamental feature of the inventive concept is to have differentiated club lengths for at least three golf clubs within the set of golf clubs since the swing motion will differ when the club length is changed.

Figure 7:
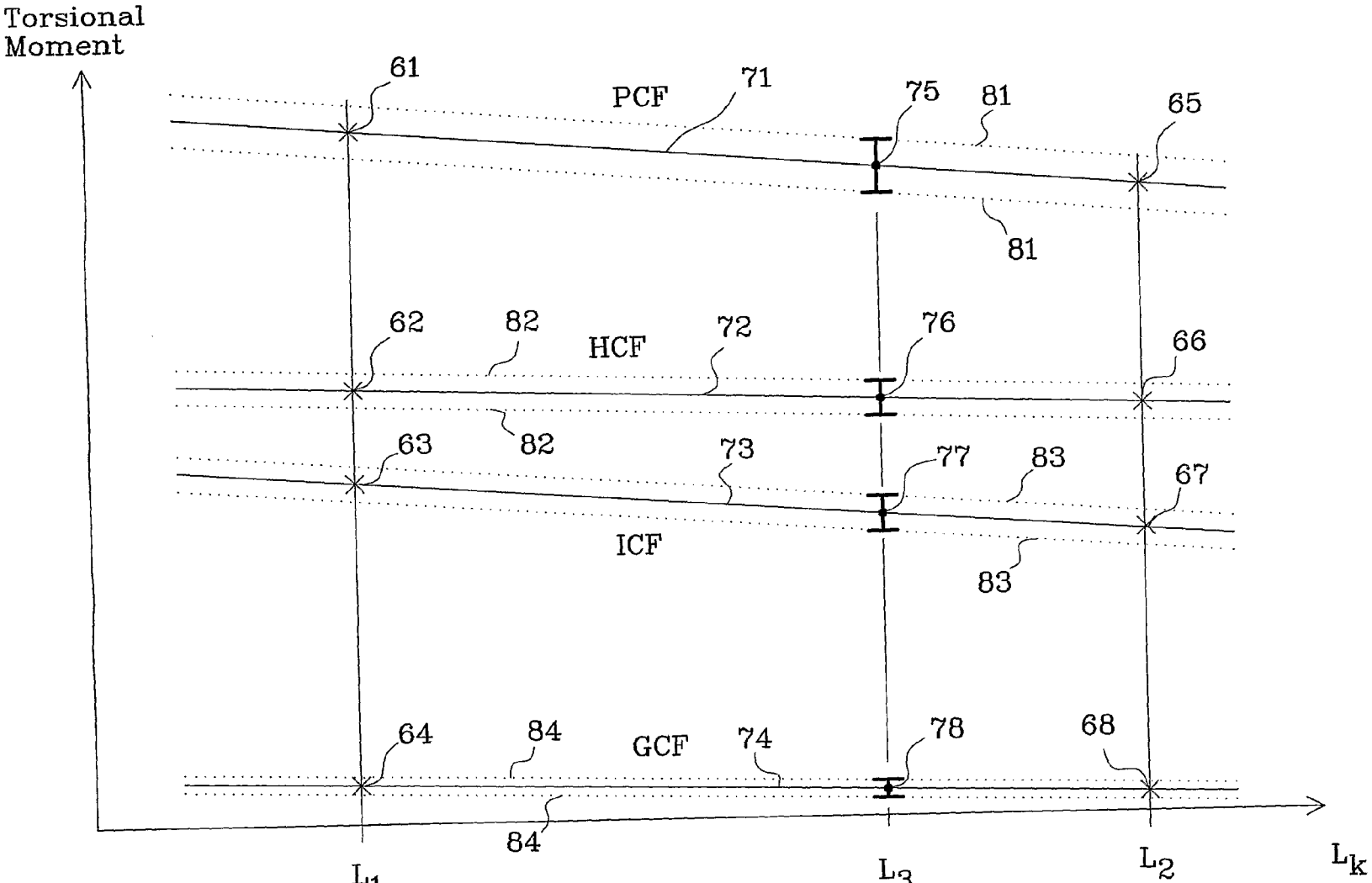
FIG. 7 shows an example of four different torsional moments as a function of club length according to the invention.

FIG. 7 shows a graph illustrating the four torsional moments discussed above. The x-axis should represent the play lengths $L_p$ of different clubs within a golf set, but the club length $L_k$ is used in FIG. 7 since $L_p$ is considered to be approximately equal to the club length $L_k$ in the examples. The y-axis represents the torsional moment for PCF, HCF, ICF and GCF. Generally, PCF (line 71) is approximately twice as high as ICF (line 73) when the balance point length and club weight is selected to fulfil equation (21) and equation (17), which is illustrated by point 53 in FIG. 4. HCF (line 72) is normally higher than ICF, and GCF (line 74) is approximately 1-2% of PCF.

Target values for golf club parameters, as described in the example below, may be derived from the torsional moments and the relationships described above. Two or more golf clubs are preferably tried out under the supervision of a club maker, to determine the golf club parameters needed to establish the slope of the torsional moments as a function of club length. Parameters related to a swing motion needs to be determined, either by measuring them in a golf analyzer equipment for a specific golfer or by using standard values related to the swing motion. The swing motion parameters are then used for all golf clubs in the golf set even though the club lengths will differ. The golf club parameters are tied to the relationships established by equation (19), equation (22), equation (29) and equation (31).

Main Example

The following example illustrates the inventive concept to create a set of golf clubs having optimal properties taking all four torsional moments into consideration. This is a non-limited example, and the values presented below will vary for each golfer.

In FIG. 7, points 61, 62, 63 and 64 illustrate the established, torsional moment for PCF, HCF, ICF and GCF, respectively, for a first reference golf club with club length $L_1$, and points 65, 66, 67 and 68 illustrate the established, torsional moment for PCF, HCF, ICF and GCF, respectively, for a second reference golf club with club length $L_2$. Straight lines 71, 72, 73 and 74 are drawn between the points representing PCF, HCF, ICF and GCF, respectively. If three or more golf clubs are used as reference golf clubs, then the lines 71-74 preferably are drawn between the points according to a least square method. This means that a square of the deviation of each point from a point on its corresponding straight line is calculated and the sum of all deviations should be as small as possible. In an example, only two golf clubs are used as references and the straight lines 71-74 may then be drawn through each point as illustrated in FIG. 7. In this example the first reference golf club with the club length $L_1$ is a 5 metalwood, the second reference golf club with the club length $L_3$ is a 9 iron.

The slope of the straight lines 71-74, i.e. $\alpha$, $\beta$, $\delta$, $\gamma$, may be obtained by trying out at least two golf clubs under the supervision of a club maker to determine parameters related to the golf clubs, such as:

club weight ($m_k$),
club length ($L_k$),
balance point length ($L_{BP}$),
club head weight ($m_{kh}$), and
CG length ($L_{CG}$)

for each golf club. The process of trying out golf clubs includes analyzing the ability to handle the golf clubs in order to consistently hit a ball and transport the ball close to a point repeatedly, i.e. approximately the same distance and direction. These golf clubs are used as reference clubs to determine at least two points on each line representing a torsional moment, as illustrated in FIG. 7.

Furthermore, swing parameters for a golfer are needed to calculate each torsional moment. The swing parameters may be determined by measuring different parameters for the golfer when swinging a club with known club length ($L_k$), i.e. swing angles ($\phi_a$, $\phi_h$), acceleration in the wrists ($a_h$), velocity in the wrists ($v_h$), acceleration in the balance point BP ($a_{BP}$), velocity in the balance point BP ($v_{BP}$), acceleration in CG of the club head ($a_{CG}$), velocity in CG of the club head ($v_{CG}$), distance between wrists and the centre of rotation ($L_a$). Other relevant club parameters, such as balance point length, club weight, club head weight and CG length, may then be calculated from the measured values.

Alternatively, a virtual swing robot is created having a swing motion in which the distance between wrists and the centre of rotation ($L_a$) is selected, e.g. 650 mm, and the velocity of club head is selected, e.g. 80 miles per hour (MPH) which corresponds to 35.76 meter per second (m/s) when swinging a virtual golf club with a predetermined club length, e.g. 1000 mm (34.39 inches). Furthermore, the virtual golf club has a predetermined balance point length, e.g. 772 mm, a predetermined club weight, e.g. 376.4 grams, a predetermined club head weight, e.g. 255 grams, and a predetermined CG length, e.g. 38.078 mm. The swing angles are selected, e.g. $\phi_a=\phi_h=135°$ and the virtual swing robot parameters, i.e. $a_{CG}$, $a_{BP}$, $a_h$, $v_{BP}$ and $v_h$, are calculated. The values $a_h$ and $v_h$ will be the same for all clubs since the virtual swing robot will have identical acceleration and velocity in the wrists for a golf club with arbitrary club length. The acceleration in the club head $a_{CG}$, and the acceleration and velocity in BP $a_{BP}$ and $v_{BP}$, will vary dependent on the shift in CG length and balance point length as a result of the calculated values for the different torsional moments, as described in more detail below.

PCF, ICF, HCF and GCF may now be calculated (based on the determined swing motion) for the reference clubs using equation (1), (2), (23) and (24), respectively, and the result is thereafter presented in a graph as a function of club length $L_k$, see FIG. 7. In this example the virtual swing robot, as described above, is used to create the swing motion. Table 1 shows two reference clubs with club parameters and calculated torsional moments.

TABLE 1

Reference club parameters and calculated torsional moments

| | Measured club parameters | | | | | Calculated Torsional Moments | | | |
|---|---|---|---|---|---|---|---|---|---|
| Club | $m_k$ [gram] | $L_{BP}$ [mm] | $L_k$ [mm] | $m_{kh}$ [gram] | $L_{CG}$ [mm] | PCF [Nm] | ICF [Nm] | HCF [Nm] | GCF [Nm] |
| Ref #1 | 343.5 | 802 | 1034 | 234.7 | 30.89 | 43.431 | 17.071 | 19.388 | 0.579 |
| Ref #2 | 408.0 | 743 | 930 | 298.9 | 34.35 | 46.899 | 17.403 | 19.974 | 0.738 |

The slope for each line is:

$$\delta = \frac{PCF(L_2) - PCF(L_1)}{L_2 - L_1} = \frac{46.9 - 43.4}{930 - 1034} = \frac{3.5}{-104} = -33.6 \cdot 10^{-3} \quad \text{(Line 71)}$$

$$\beta = \frac{HCF(L_2) - HCF(L_1)}{L_2 - L_1} = \frac{20.0 - 19.4}{930 - 1034} = \frac{0.6}{-104} = -5.77 \cdot 10^{-3} \quad \text{(Line 72)}$$

$$\alpha = \frac{ICF(L_2) - ICF(L_1)}{L_2 - L_1} = \frac{17.4 - 17.1}{930 - 1034} = \frac{0.3}{-104} = -2.88 \cdot 10^{-3} \quad \text{(Line 73)}$$

$$\gamma = \frac{GCF(L_2) - GCF(L_1)}{L_2 - L_1} = \frac{0.738 - 0.579}{930 - 1034} = \frac{0.159}{-104} = -1.53 \cdot 10^{-3} \quad \text{(Line 74)}$$

Target values for PCF, HCF, ICF and GCF is calculated when a length ($L_3$) of a golf club is selected, e.g. $L_3$=965 mm for a 5 iron. The following target values for the torsional moments will then be calculated using the above mentioned slope:

$$PCF(L_3)=45.732$$

$$HCF(L_3)=19.777$$

$$ICF(L_3)=17.291$$

$$GCF(L_3)=0.684$$

The target values, 75, 76, 77 and 78, respectively, are indicated with a filled circle on each straight line, and a maximum deviation from each target value is also indicated.

The actual PCF value of the resulting golf club may vary between the dotted lines 81 which results in a deviation that preferably is less than ±0.5%, more preferably less than ±0.2%, of the target value 75. The actual HCF value of the resulting golf club may vary between the dotted lines 82 which results in a deviation that preferably is less than ±1%, more preferably less than ±0.5%, of the target value 76. The actual ICF value of the resulting golf club may vary between the dotted lines 83 which results in a deviation that preferably is less than ±1%, more preferably less than ±0.5%, of the target value 77. The actual GCF value of the resulting golf club may vary between the dotted lines 84 which results in a deviation that preferably is less than ±5%, more preferably less than ±2%, of the target value 78.

Furthermore, target values for some golf club parameters are also calculated when the club length is selected, e.g. target values for club weight, balance point length, golf head weight and CG length, using the relationships established between the torsional moments and the golf club parameters, as illustrated in table 2.

TABLE 2

Target values for a 5 iron having club length = 965 mm.

| | | Target club parameters | | | | Target Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 5 iron | 965 | 761.4 | 386.0 | 274.9 | 30.89 | 45.732 ± 0.229 | 17.291 ± 0.173 | 19.777 ± 0.198 | 0.684 ± 0.034 |

The 5 iron golf club is then assembled with relevant components, such as shaft, club head, and grip, having actual values being as close as possible to the target values. The actual values are then used to calculate the torsional moments using equation (1), (2), (23) and (24). The actual values and calculated torsional values are presented in table 3.

TABLE 3

Actual values for a 5 iron having club length = 965 mm and calculated torsional moments.

| | | Actual club parameters | | | | Calculated Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 5 iron | 965 | 761.4 | 386.0 | 274.9 | 33.39 | 45.731 | 17.290 | 19.787 | 0.685 |

It should be noted that the calculated values differ from the target values for the torsional moments even though the actual club parameters is identical to the target values for the club parameters, since the calculated torsional moments are calculated from the actual club parameters and the target torsional moments are obtained from the straight lines generated by the reference clubs.

The club weight $m_k$ is a summation of club head weight $m_{kh}$, shaft weight $m_s$ and grip weight $m_g$:

$$m_k = m_{kh} + m_s + m_g \Rightarrow m_s = m_k - m_g - m_{kh} \tag{32}$$

Furthermore the balance point length $L_{BP}$ depends on a grip balance point length $L_{BP,g}$, the grip weight $m_g$, a shaft balance point length $L_{BP,S}$, the shaft weight $m_s$, the club length $L_k$, the club head weight $m_{kh}$ and the club weight $m_k$. $\Delta_g$ is the thickness of the grip butt-end, which normally is approximately 5 mm.

$$m_k \cdot L_{BP} = m_g \cdot L_{BP,g} + m_s \cdot (L_{BP,s} + \Delta_g) + m_{kh} \cdot L_k \tag{33}$$

$$\Rightarrow L_{BP,s} = \frac{m_k \cdot L_{BP} - m_g \cdot L_{BP,g} - m_{kh} \cdot L_k}{m_s} - \Delta_g$$

The grip section is preferably a standard grip having a predetermined weight and balance point length, the club weight, club length, balance point length and club head weight are known. The shaft weight and the shaft balance point length may be determined from equation (32) and (33).

TABLE 4

Actual parameters for components of a 5 iron golf club ($\Delta_g$ = 5 mm).

| Club | $L_k$ [mm] | $m_{kh}$ [grams] | $L_{CG}$ [mm] | $m_g$ [grams] | $L_{BP,g}$ [mm] | $L_{BP,s}$ [mm] | $m_s$ [grams] | $m_k$ [grams] | $L_{BP}$ [mm] |
|---|---|---|---|---|---|---|---|---|---|
| 5 iron | 965 | 274.9 | 33.39 | 45 | 90 | 367.2 | 66.1 | 386.0 | 761.4 |

The swingweight for the assembled 5 iron may now be calculated using the swingweight formula:

$$swingweight = (L_{BP}(\text{inches}) - 14'') \cdot m_k(\text{ounces}) \tag{34}$$

$$= \left(\frac{L_{BP}(\text{mm})}{25.4} - 14\right) \cdot \frac{m_k(\text{mm})}{28.35}$$

The swingweight for the assembled 5 iron is 217.5 [in oz], which corresponds to D 2.3 in a swingweight table.

The set of golf clubs may naturally comprise more than three golf clubs, and the example below seven golf clubs (3 iron-9 iron) are built based on the straight lines 71-74 describing the torsional moments. The following target values are obtained:

TABLE 5

Target values for 3 iron-9 iron based on the reference clubs in table 1. The target torsional moments are presented without allowed deviation.

| | | Target club parameters | | | | Target Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 3 iron | 990 | 775.5 | 370.4 | 259.3 | 32.58 | 44.898 | 17.211 | 19.636 | 0.646 |
| 4 iron | 978 | 768.6 | 377.9 | 266.6 | 32.99 | 45.299 | 17.250 | 19.704 | 0.666 |
| 5 iron | 965 | 761.4 | 386.0 | 274.9 | 33.39 | 45.732 | 17.291 | 19.777 | 0.684 |
| 6 iron | 952 | 754.4 | 394.1 | 283.5 | 33.77 | 46.166 | 17.333 | 19.850 | 0.704 |
| 7 iron | 940 | 748.1 | 401.7 | 291.7 | 34.10 | 46.566 | 17.371 | 19.918 | 0.723 |
| 8 iron | 927 | 741.5 | 409.9 | 301.1 | 34.42 | 46.999 | 17.412 | 19.991 | 0.742 |
| 9 iron | 914 | 735.0 | 418.2 | 310.9 | 34.72 | 47.433 | 17.454 | 20.065 | 0.762 |

The difference in length between each golf club is approximately ½ inch (12.7 mm) and the loft of the head increases through the set as the club length decreases. Conventionally, the club head weight increases with seven grams for each ½ inch reduction in length. However, the head weights in the inventive set of golf club do not have a fixed weight difference for each ½ inch, as is obvious from table 5. The head weight difference between a 3 iron and a 4 iron is 7.5 grams, but the head weight difference between an 8 iron and a 9 iron is 9.8 grams. Furthermore, the CG length is not constant for the golf clubs within the set, and increases as the length of the golf club decreases. The club head weight difference and CG length differences are individually obtained for each golfer and may vary.

If the grip weight and grip balance point is identical for the golf clubs in the set, the following golf club parameters may be obtained:

TABLE 6

Actual parameters for components of 3 iron-9 iron clubs ($\Delta_g$ = 5 mm).

| Club | $L_k$ [mm] | $m_{kh}$ [grams] | $L_{CG}$ [mm] | $L_{BP,s}$ [mm] | $m_s$ [grams] | $m_k$ [grams] | $L_{BP}$ [mm] | swingweight |
|---|---|---|---|---|---|---|---|---|
| 3 iron | 990 | 259.3 | 32.58 | 395.7 | 66.1 | 370.4 | 775.5 | 216.0 D 1.4 |
| 4 iron | 978 | 266.6 | 32.99 | 382.1 | 66.3 | 377.9 | 768.6 | 216.7 D 1.9 |
| 5 iron | 965 | 274.9 | 33.39 | 367.2 | 66.1 | 386.0 | 761.4 | 217.5 D 2.3 |
| 6 iron | 952 | 283.5 | 33.77 | 351.8 | 65.7 | 394.1 | 754.4 | 218.3 D 2.7 |
| 7 iron | 940 | 291.7 | 34.10 | 337.2 | 64.9 | 401.7 | 748.1 | 219.0 D 3.1 |
| 8 iron | 927 | 301.1 | 34.42 | 320.5 | 63.8 | 409.9 | 741.5 | 219.7 D 3.5 |
| 9 iron | 914 | 310.9 | 34.72 | 302.8 | 62.3 | 418.2 | 735.0 | 220.3 D 3.9 |

It should be noted that the although the total weight of the golf club is increasing with shorter club length, the weight of the shaft is rather constant for the longer clubs (3 iron, 4 iron and 5 iron) and is increasingly reduced for the shorter clubs (7 iron, 8 iron and 9 iron). The shaft balance point length is increasingly reduced with shorter clubs, and the swingweight is gradually increased with shorter clubs.

Iron clubs are used to illustrate the inventive concept, but it is naturally possible to design other types of golf clubs, such as metal woods, drivers, wedges and putters, using the same methodology.

It should be noted that the first torsional moment (i.e. PCF) is a load that affects the golfer at the centre of rotation 15, in FIG. 1, and the second, third and fourth torsional moments (i.e. ICF, HCF and GCF) are loads that affects the golfer at the wrists 16, in FIG. 1.

Each torsional moment may be separately used to adapt a set of golf clubs to its user. However, it should be noted that each torsional moment is not independent of the other torsional moments as is obvious from the equations presented above. A change in any torsional moment for a golf club will affect one or more additional torsional moments. Four examples are illustrated below to highlight each torsional moment.

PCF

The Plane control factor (PCF) is a function of the club weight $m_k$, the balance point length $L_{BP}$ and a constant $L_a$ (which is related to the arm length of the golfer), as is obvious from equation (21). A set of golf clubs, in which each golf club has a predetermined length, may be adjusted by altering the balance point length and club weight of a short golf club to determine a suitable PCF for the short club, which is obtained when the golfer stabilizes the swing plane and velocity at impact. The same procedure is repeated for a longer golf club to determine a suitable PCF for the longer golf club. A straight line having a slope is drawn between the two PCF values as a function of club length. The club weight and balance point length may now be adjusted on the rest of the golf clubs within the set.

PCF is preferably combined with the Impact Control Factor (ICF), which is a function of the club weight and the balance point length, as is obvious from equation (17). PCF in combination with ICF will generate an optimum balance point length and club weight for a given PCF and a given ICF, as is obvious from the description in relation to FIG. 4 and equation (13).

ICF

Impact Control Factor is a function of the club weight and the balance point length, as is obvious from equation (17). A set of golf clubs, in which each golf club has a predetermined length, may be adjusted by altering the balance point length and club weight of a short golf club to determine a suitable ICF for the short club, which is obtained when feeling of the golf head and the wrist action through the swing is consistent. The same procedure is repeated for a longer golf club to determine a suitable ICF for the longer golf club. A straight line having a slope is drawn between the two ICF values as a function of club length. The club weight and balance point length may now be adjusted on the rest of the golf clubs within the set.

ICF is preferably combined with Plane Control Factor (PCF), which is a function of club weight $m_k$, balance point length $L_{BP}$ and a constant $L_a$ (which is related to the arm length of the golfer), as is obvious from equation (21). ICF in combination with PCF will generate an optimum balance point length and club weight for a given PCF and a given ICF, as is obvious from the description in relation to FIG. 54 and equation (13).

HCF

Head Control Factor is a function of the club length $L_k$ and the club head weight $m_{kh}$, as is obvious from equation (28). A set of golf clubs, in which each golf club has a predetermined length, may be adjusted by altering the club head weight of a short golf club to determine a suitable HCF for the short club, which is obtained when the impact on the ball is consistent in the club head. The same procedure is repeated for a longer golf club to determine a suitable HCF for the longer golf club. A straight line having a slope is drawn between the two HCF values as a function of club length. The club head weight may now be adjusted on the rest of the golf clubs within the set.

HCF is preferably combined with Gear Control Factor (GCF), which is a function of club length $L_k$, CG length $L_{CG}$ and club head weight $m_{kh}$, as is obvious from equation (30). HCF in combination with GCF will generate an optimum CG length for a given HCF and a given GCF, as is obvious from equation (25).

GCF

Gear Control Factor (GCF) is particularly suitable for improving a traditionally designed set of golf clubs. GCF is a function of club length $L_k$, CG length $L_{CG}$ and club head weight $m_{kh}$, as is obvious from equation (30). A set of golf clubs, in which each golf club has a predetermined length, may be adjusted by altering the CG length of a short golf club to determine a suitable GCF for the short club, which is obtained when the feeling of the golf head is consistent, the golfer is able to work the ball (control draw/fade] consistently and the golfer is able to control the angle of the head in relation to the swing plane consistently. The same procedure is repeated for a longer golf club to determine a suitable GCF for the longer golf club. A straight line having a slope is drawn between the two GCF values as a function of club length. The CG length may now be adjusted on the rest of the golf clubs within the set.

GCF is preferably combined with Head Control Factor (HCF), which is a function of club length $L_k$, and club head weight $m_{kh}$, as is obvious from equation (28). GCF in combination with HCF will generate an optimum CG length for a given GCF and a given HCF, as is obvious from equation (26).

It is more preferred to combine all four torsional moments when designing a set of golf clubs, as illustrated above in connection with the description of tables 1-6, but the invention should not be limited to this. Each of the described torsional moments will improve a conventional set of golf clubs.

The important characteristics of the invention is not to obtain lower/higher torsional moments than prior art, but to give the golfer the proper loads to enable to repeat the same swing motion over and over again (get the proper feedback), and thus maximizing the golfer's potential in golf.

The invention claimed is:

1. A set of at least three golf clubs having different club lengths $L_k$, each of the golf clubs having a shaft with an upper end and a lower end, a grip section on the upper end of the shaft, and a head with a ball-striking surface mounted on the lower end of the shaft, the club length $L_k$ of each golf club decreasing through the set, each golf club having a balance point length $L_{BP,n}$ defined from the distal end of the grip section to a balance point BP, and a club weight $m_{k,n}$, wherein a value of at least one torsional moment for each of the at least three golf clubs when swung by a golfer differs from each other, and a linear function of club length $L_k$ is based on said values of at least one torsional moment, each golf club generates when swung by the golfer:

a first torsional moment $PCF_n$ at a rotational centre for the swing motion of the golfer for each golf club, and a second torsional moment $ICF_n$ at the wrists of the golfer for each of the at least three golf clubs having a relationship to said first torsional moment $PCF_n$ expressed as:

$$ICF_n = \left(\frac{PCF_n}{(L_{BP,n} + L_a)\cdot m_{k,n}} - a_h\right)\cdot L_{BP,n}\cdot m_{k,n}$$

wherein $ICF_n$ is the second torsional moment, $PCF_n$ is the first torsional moment for golf club n having a balance point length $L_{BP,n}$ and a club weight $m_{k,n}$, $a_h$ is a constant representing acceleration of the wrists of the golfer when hitting the ball and $L_a$ is a constant related to the golfer's arm length.

2. The set according to claim 1, wherein said first torsional moment PCF for each golf club n is a function of the club weight $m_{k,n}$, the balance point length $L_{BP,n}$ and the constant $L_a$ related to the golfer's arm length:

$$PCF_n = f\{m_{k,n}, (L_{BP,n}+L_a), (2\cdot L_{BP,n}+L_a)\}$$

3. The set according to claim 2, wherein a first of said at least three golf clubs has a relationship to a second of said at least three golf clubs expressed as:

$$m_{k,1}(L_{BP,1}+L_a)\cdot(2L_{BP,1}+L_a) = \delta\cdot m_{k,2}(L_{BP,2}+L_a)\cdot(2L_{BP,2}+L_a);\ \delta\neq 1,$$

wherein $m_{k,1}$ is the weight and $L_{BP,1}$ is the balance point length of said first golf club; $m_{k,2}$ is the weight and $L_{BP,2}$ is the balance point length of said second golf club, and $L_a$ is the constant related the golfer's arm length.

4. The set according to claim 1, wherein said second torsional moment for each club n is a function of the club weight $m_{k,n}$ and the balance point length $L_{BP,n}$ expressed as:

$$ICF = f\{m_k, (L_{BP})^2\}.$$

5. The set according to claim 4, wherein a first of said at least three golf clubs has a relationship to a second of said at least three golf clubs expressed as:

$$m_{k,1}(L_{BP,1})^2 = \alpha\cdot m_{k,2}(L_{BP,2})^2;\ \alpha\neq 1,$$

wherein $m_{k,1}$ is the weight and $L_{BP,1}$ is the balance point length of said first golf club; and $m_{k,2}$ is the weight and $L_{BP,2}$ is the balance point length of said second golf club.

6. The set according to claim 1, wherein each golf club n has a club head weight $m_{k,n}$ with a centre of gravity CG arranged in a plane perpendicular to a first direction along the centre of the shaft, said club length $L_{k,n}$ is defined as a first distance from the distal end of the grip section to said plane along the first direction, each golf club creates when swung by a golfer a third torsional moment $HCF_n$ for each golf club, said third torsional moment is proportional to the product of the club head weight $m_{kh,n}$ and the square of club length $L_{k,n}$:

$$HCF_n \propto m_{kh,n}\cdot(L_{k,n})^2.$$

7. The set according to claim 6, wherein a first of said at least three golf clubs has a relationship to a second of said at least three golf clubs expressed as:

$$m_{kh,1}(L_{k,1})^2 = \beta\cdot m_{kh,2}(L_{k,2})^2;\ \beta\neq 1$$

wherein $m_{kh,1}$ is the head weight and $L_{k,1}$ is the club length of said first golf club; and $m_{kh,2}$ is the head weight and $L_{k,2}$ is the club length of said second golf club.

8. The set according to claim 6, wherein each golf club n creates when swung by a golfer a fourth torsional moment $GCF_n$ for each of the at least three golf clubs having a relationship to said third torsional moment $HCF_n$ expressed as:

$$GCF_n = \frac{HCF_n\cdot L_{CG,n}}{L_{k,n}}$$

wherein $HCF_n$ is the third torsional moment, $GCF_n$ is the fourth torsional moment for golf club n with the club length $L_{k,n}$ and a CG length $L_{CG,n}$, said CG length is arranged in said plane and represents a distance from a zero point in the plane, said zero point is in the prolongation of the centre of the shaft along the first direction, to one of:

the centre of gravity CG, or a point on a line through a sweet spot on said ball-striking surface and said centre of gravity CG.

9. The set according to claim 1, wherein each golf club n has a club head weight $m_{kh,n}$ with a centre of gravity CG arranged in a plane perpendicular to a first direction along the centre of the shaft, said club length $L_{k,n}$ is defined as a first distance from the distal end of the grip section to said plane along the first direction, said at least one torsional moment comprises a fourth torsional moment $GCF_n$ for each golf club, said fourth torsional moment is proportional to the product of the club head weight $m_{k,n}$, a CG length $L_{CG,n}$, and the club length $L_{k,n}$:

$$GCF_n \propto m_{kh,n}\cdot L_{k,n}\cdot L_{CG,n},$$

said CG length is arranged in said plane and represents a distance from a zero point in the plane, said zero point is in the prolongation of the centre of the shaft along the first direction, to one of:

the centre of gravity CG, or a point on a line through a sweet spot on said ball-striking surface and said centre of gravity CG.

10. The set according to claim 9, wherein a first of said at least three golf clubs has a relationship to a second of said at least three golf clubs expressed as:

$$m_{kh,1} \cdot L_{k,1} \cdot L_{CG,1} = \gamma \cdot m_{kh,2} \cdot L_{k,2} \cdot L_{CG,2};\ \gamma \neq 1$$

wherein $m_{kh,1}$ is the head weight, $L_{k,1}$ is the club length and $L_{CG,1}$ is the CG length of said first golf club; and $m_{kh,2}$ is the head weight, $L_{k,2}$ is the club length and $L_{CG,2}$ is the CG length of said second golf club.

11. The set according to claim 9, wherein each golf club n creates when swung by a golfer a third torsional moment $HCF_n$ for each of the at least three golf clubs having a relationship to said fourth torsional moment $GCF_n$ expressed as:

$$HCF_n = \frac{GCF_n \cdot L_{k,n}}{L_{CG,n}}$$

wherein $HCF_n$ is the third torsional moment, $GCF_n$ is the fourth torsional moment for golf club n with the club length $L_{k,n}$ and a CG length $L_{CG,n}$, said CG length is arranged in said plane and represents a distance from a zero point in the plane, said zero point is in the prolongation of the centre of the shaft along the first direction, to one of: the centre of gravity CG or a point arranged between a sweet spot on said ball-striking surface and said centre of gravity CG.

12. The set according to claim 1, wherein the loft of the head increases through the set and the length of golf club decreasing through the set as the loft of each head increases.

13. The set according to claim 1, wherein said linear function of club length $L_{k,n}$ defines target values for each of said at least three golf clubs, and each value of the at least one torsional moment for each golf club with a deviation less than a predetermined value from each target value.

14. The set according to claim 1, wherein the linear function passes through at least two of said values of the at least one torsional moment for said golf clubs.

15. The set according to claim 1, wherein the linear function is based on a least square calculation of said values of the at least one torsional moment for said golf clubs.

16. A set of at least three golf clubs having different club lengths $L_k$, each of the golf clubs having a shaft with an upper end and a lower end, a grip section on the upper end of the shaft, and a head with a ball-striking surface mounted on the lower end of the shaft, the club length $L_{k,n}$ of each golf club decreasing through the set, each golf club n having a club head weight $m_{kh,n}$ with a centre of gravity CG arranged in a plane perpendicular to a first direction along the centre of the shaft, said club length $L_{k,n}$ is defined as a first distance from the distal end of the grip section to said plane along the first direction, wherein a value of at least one torsional moment for each of the at least three golf clubs when swung by a golfer differs from each other, and a linear function of club length $L_k$ is based on said values of at least one torsional moment, each golf club n generates when swung by a golfer:

a third torsional moment $HCF_n$ for each golf club, said third torsional moment is proportional to the product of the club head weight $m_{kh,n}$ and the square of club length $L_{k,n}$, and a fourth torsional moment $GCF_n$ for each of the at least three golf clubs having a relationship to said third torsional moment $HCF_n$ expressed as:

$$GCF_n = \frac{HCF_n \cdot L_{CG,n}}{L_{k,n}}$$

wherein $HCF_n$ is the third torsional moment, $GCF_n$ is the fourth torsional moment for golf club n with the club length $L_{k,n}$ and a CG length $L_{CG,n}$, said CG length is arranged in said plane and represents a distance from a zero point in the plane, said zero point is in the prolongation of the centre of the shaft along the first direction, to one of:

the centre of gravity CG, or a point on a line through a sweet spot on said ball-striking surface and said centre of gravity CG.

17. The set according to claim 16, wherein a first of said at least three golf clubs has a relationship to a second of said at least three golf clubs expressed as:

$$m_{kh,1}(L_{k,1})^2 = \beta \cdot m_{kh,2}(L_{k,2})^2;\ \beta \neq 1$$

wherein $m_{kh,1}$ is the head weight and $L_{k,1}$ is the club length of said first golf club; and $m_{kh,2}$ is the head weight and $L_{k,2}$ is the club length of said second golf club.

18. The set according to claim 16, wherein said fourth torsional moment is proportional to the product of the club head weight $m_{kh,n}$, the CG length $L_{CG,n}$, and the club length $L_{k,n}$.

19. The set according to claim 18, wherein a first of said at least three golf clubs has a relationship to a second of said at least three golf clubs expressed as:

$$m_{kh,1} \cdot L_{k,1} \cdot L_{CG,1} = \gamma \cdot m_{kh,2} \cdot L_{k,2} \cdot L_{CG,2}$$

wherein $m_{kh,1}$ is the head weight, $L_{k,1}$ is the club length and $L_{CG,1}$ is the CG length of said first golf club; $m_{kh,2}$ is the head weight, $L_{k,2}$ is the club length and $L_{CG,2}$ is the CG length of said second golf club; and $\gamma$ is the slope of a linear function.

20. The set according to claim 19, wherein a value of the fourth torsional moment GCF for each golf club differs from each other: $\gamma \neq 1$.

* * * * *